US007872187B1

(12) United States Patent
Kushner

(10) Patent No.: US 7,872,187 B1
(45) Date of Patent: Jan. 18, 2011

(54) HYBRID CASES FOR THE PROTECTION OF UP TWO STRINGED MUSICAL INSTRUMENTS

(76) Inventor: Daniel Watson Kushner, 62 Hillview Ave., San Rafael, CA (US) 94901

( * ) Notice: Subject to any disclaimer, the term of this patent is extended or adjusted under 35 U.S.C. 154(b) by 119 days.

(21) Appl. No.: 12/386,463

(22) Filed: Apr. 17, 2009

Related U.S. Application Data

(63) Continuation-in-part of application No. 12/069,607, filed on Feb. 11, 2008, now Pat. No. 7,687,701.

(51) Int. Cl.
*G10D 9/00* (2006.01)

(52) U.S. Cl. ..... 84/453; 206/314

(58) Field of Classification Search ..... 84/453; 206/314; 190/109, 111; D7/628; D3/204
See application file for complete search history.

(56) References Cited

U.S. PATENT DOCUMENTS

| | | | | |
|---|---|---|---|---|
| 3,000,417 | A | 9/1961 | Goldstein | |
| 3,901,384 | A | 8/1975 | Lee et al. | 206/314 |
| 4,065,995 | A * | 1/1978 | Greer | 84/465 |
| 4,190,152 | A | 2/1980 | Reiter | 206/314 |
| 4,531,632 | A | 7/1985 | Weber | 206/14 |
| 4,659,000 | A | 4/1987 | Sales et al. | 224/252 |
| 4,738,340 | A | 4/1988 | Crespi | 190/18 |
| 4,795,030 | A | 1/1989 | Boyce | 206/314 |
| 4,846,340 | A | 7/1989 | Walther | 206/14 |
| 5,441,134 | A * | 8/1995 | Carson | 190/111 |
| 5,833,051 | A | 11/1998 | Tiefenbrun et al. | 206/14 |
| 6,000,509 | A * | 12/1999 | Chisholm | 190/109 |
| 6,029,804 | A | 2/2000 | Flynn | 206/14 |
| 6,126,012 | A * | 10/2000 | Roegner | 206/579 |
| 6,283,287 | B1 | 9/2001 | Carl | 206/314 |
| 6,499,592 | B2 | 12/2002 | Wilfer | 206/314 |
| 6,670,536 | B2 | 12/2003 | Godin et al. | 84/453 |
| D487,627 | S | 3/2004 | Izen et al. | D3/204 |

(Continued)

FOREIGN PATENT DOCUMENTS

JP 2002366143 A 12/2002

OTHER PUBLICATIONS

Incase Dub Bag, author unknown, printed Apr. 11, 2009, 2 pages from website with URL http://www.goincase.com/products/detail/dub-bag-cl56066.

(Continued)

*Primary Examiner*—Jianchun Qin
(74) *Attorney, Agent, or Firm*—ThePatentSource

(57) ABSTRACT

Disclosed musical instrument cases have a semi-rigid, continuous sidewall defining a front edge with opposing first and second elongated sides and a back edge with opposing first and second elongated sides. The cases also have a partition, with front and back surfaces, attached to the sidewall. The cases have a front cover hingedly connected to the second elongated side of the front edge and releasably fastened to the first elongated side of the front edge. Conversely, the cases have a back cover hingedly connected to the first elongated side of the back edge and releasably fastened to the second elongated side of the back edge. The front cover may selectively enclose a front region of space between the front cover and the front surface of partition and, independently, the back cover may selectively enclose a back region of space between the back cover and the partition back surface.

20 Claims, 4 Drawing Sheets

U.S. PATENT DOCUMENTS

| | | | | |
|---|---|---|---|---|
| 2003/0066770 | A1 * | 4/2003 | Heesch | 206/314 |
| 2006/0230905 | A1 | 10/2006 | Stanley | 84/328 |
| 2007/0204742 | A1 * | 9/2007 | Wilkerson | 84/329 |
| 2008/0060956 | A1 * | 3/2008 | Izen et al. | 206/314 |

OTHER PUBLICATIONS

Incase Dub Bag, author unknown, printed Aug. 7, 2009, 7 pages from website with URL http://www.goincase.com/products/detail/dub-bag-cl56066.

Attitude Double Guitar Bag GAV-EG30, author unknown, printed Aug. 7, 2009, 2 pages from website with URL http://www.rondomusic.com/gaveg30.html.

Undercover Double Gig Bags, author unknown, printed Aug. 7, 2009, 5 pages from website with URL http://www.bassexchange.com/cataloq/index.php?cPath=38_ 159.

Gator Double Bass Guitar Slinger Gig Bag (G-Sling-2X-Bass), author unknown, printed Aug. 7, 2009, 1 page from website with URL http://www.interstatemusic.com/webapp/wcs/stores/servlet/ProductDisplay?storeId=10051&langId=-1&catalogId=10001&productId=900228619#.

ProTec CF233D—Deluxe Double Bass Guitar Gig Bag, author unknown, printed Aug. 7, 2009, 5 pages from website with URL http://www.casesandmore.com/PRO-TEC-CF233D-PRO1083.html.

Image Allow Cases: double guitar case, author unknown, printed Aug. 7, 2009, 1 page from website with URL http://www.imageal-loycases.com.au/alum_av2.html?pid=23.

IKA double guitar case, author unknown, printed Aug. 7, 2009, 2 pages from website with URL http://www.ika.zrns.cz/im-new/guit-db.jpg.

* cited by examiner

HYBRID CASES FOR THE PROTECTION OF UP TWO STRINGED MUSICAL INSTRUMENTS

CROSS REFERENCE TO RELATED CASES

This is a continuation-in-part application of U.S. application Ser. No. 12/069,607 (now U.S. Pat. No. 7,687,701) with a filing date of Feb. 11, 2008 and entitled "Hybrid Cases for The Protection of Stringed Musical Instruments". Applicant hereby claims the benefit of and incorporates this aforementioned application by reference in its entirety.

BACKGROUND OF THE INVENTION

1. Field of the Invention

The present invention is directed to hybrid cases for the protection of stringed musical instruments. More particularly, the invention relates hybrid cases that provide enhanced protection and convenience for either one or two such instruments. Accordingly, the general objects of the invention are to provide novel methods and apparatus of such character.

2. Description of the Related Art

The worldwide popularity of stringed instruments such as guitars, basses, cellos, violins, mandolins, ukuleles, etc in the last several decades has led to many advances in these instruments as well as related accessories. One such accessory that has seen a wide variety of improvements is the protective case. Such cases are now available in a number of basic styles with a wide variety of materials and features that offer some combination of improved ergonomics, lower cost, lighter weight, and/or better protection. For example, instrument cases are now available in three basic styles (the soft case—or gig-bag—, the hard-shell case and the hybrid case). Cases for protecting individual guitars are now widely available in all of these three styles.

Some musicians who play stringed musical instruments such as guitars, ukuleles, mandolins, etc., however, play more than one instrument during the course of a performance. This may be because alternative instruments are tuned to different keys, because the instruments are of different types, such as six-string and twelve string varieties, or simply because variation between instruments simply makes one preferred by the artist over another for the performance of a particular song. The availability of a second instrument also allows the performer to rapidly switch from one instrument to another as in the case of string breakage during a performance. When more than one instrument case has to be carried by a musician, however, it results in a bulky, awkward load to be carried. This is particularly true since most conventional hard shell cases are made of a heavy, crush-proof material that significantly enlarges the volume of the carrying case.

In an effort to overcome these deficiencies and improve convenience, rudimentary double cases have been developed. Two examples of such designs include U.S. Pat. Nos. 6,283,287 and 4,795,030. While these and other designs presently available on the market do accommodate two stringed instruments, they also fall short of providing an optimal combination of protection, convenience and economy.

It is therefore, a primary object of the present invention to provide improvements in carrying cases for stringed musical instruments which overcome the disadvantages associated with earlier types of cases.

SUMMARY OF THE INVENTION

The present invention satisfies the above-stated needs and overcomes the above-stated and other deficiencies of the related art by providing hybrid cases for the simultaneous protection and transportation of up to two stringed instruments offering improved protection and convenience.

In particular, the present invention is directed to a protective hybrid case with a semi-rigid, continuous sidewall defining a front edge with opposing first and second elongated sides and a back edge with opposing first and second elongated sides. The case may also include a partition fixedly attached to the sidewall and having front and back surfaces. Additionally, the case may have a front cover hingedly connected to at least a portion of the second elongated side of the front edge of the sidewall and releasably fastened to at least a portion of the first elongated side of the front edge of the sidewall. Similarly, the case may have a back cover hingedly connected to at least a portion of the first elongated side of the back edge of the sidewall and releasably fastened to at least a portion of the second elongated side of the back edge of the sidewall. This arrangement permits the front cover to selectively enclose a front region of space between the front cover and the front surface of partition and permits the back cover to selectively enclose a back region of space between the back cover and the back surface of the partition. Thus, closure of the front and back covers are independent of one another.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
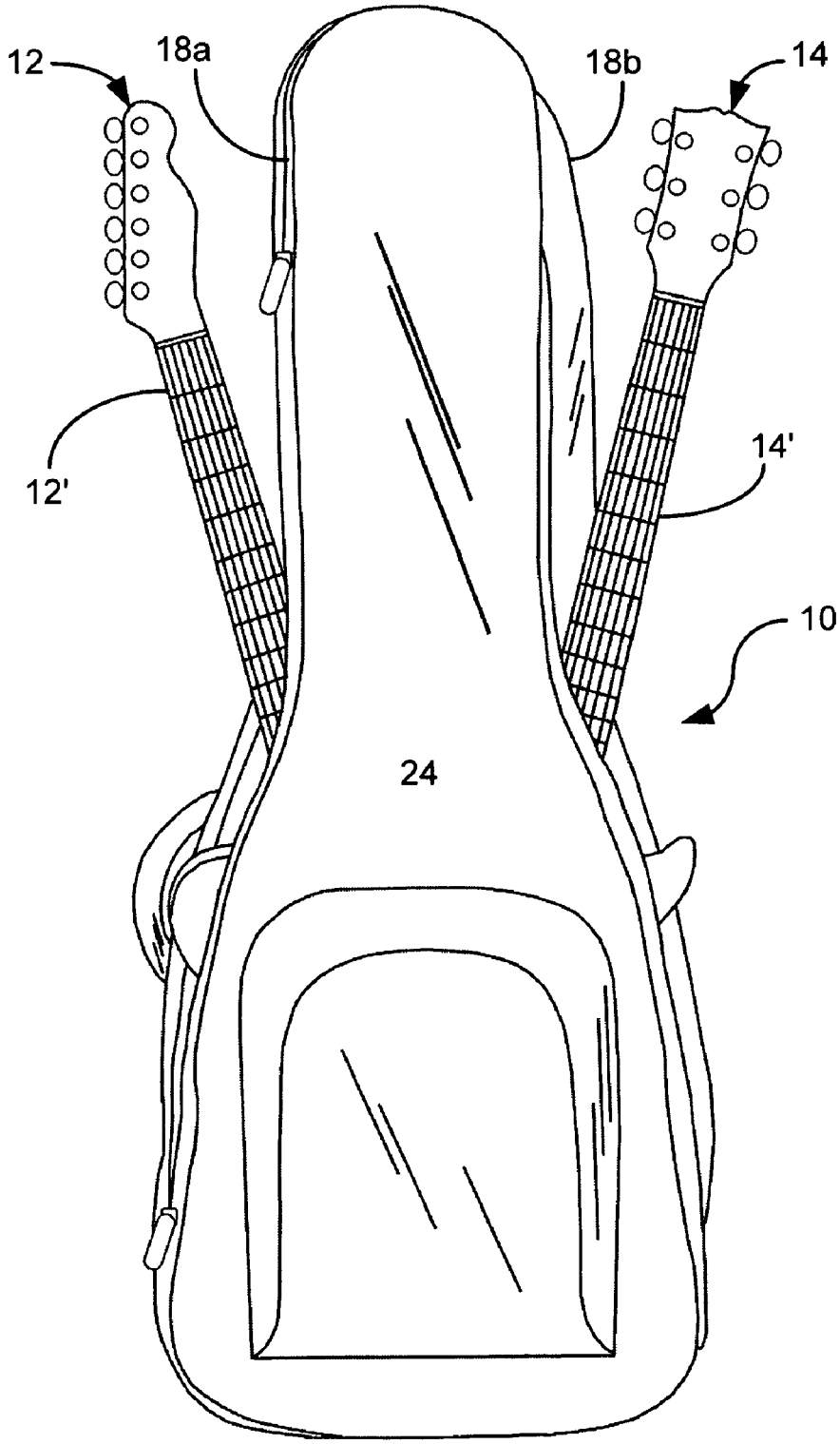
FIG. 1*a* is a front elevation view of a protective hybrid case in accordance with one preferred embodiment of the present invention with two instruments partially enclosed inside.
Figure 1B:
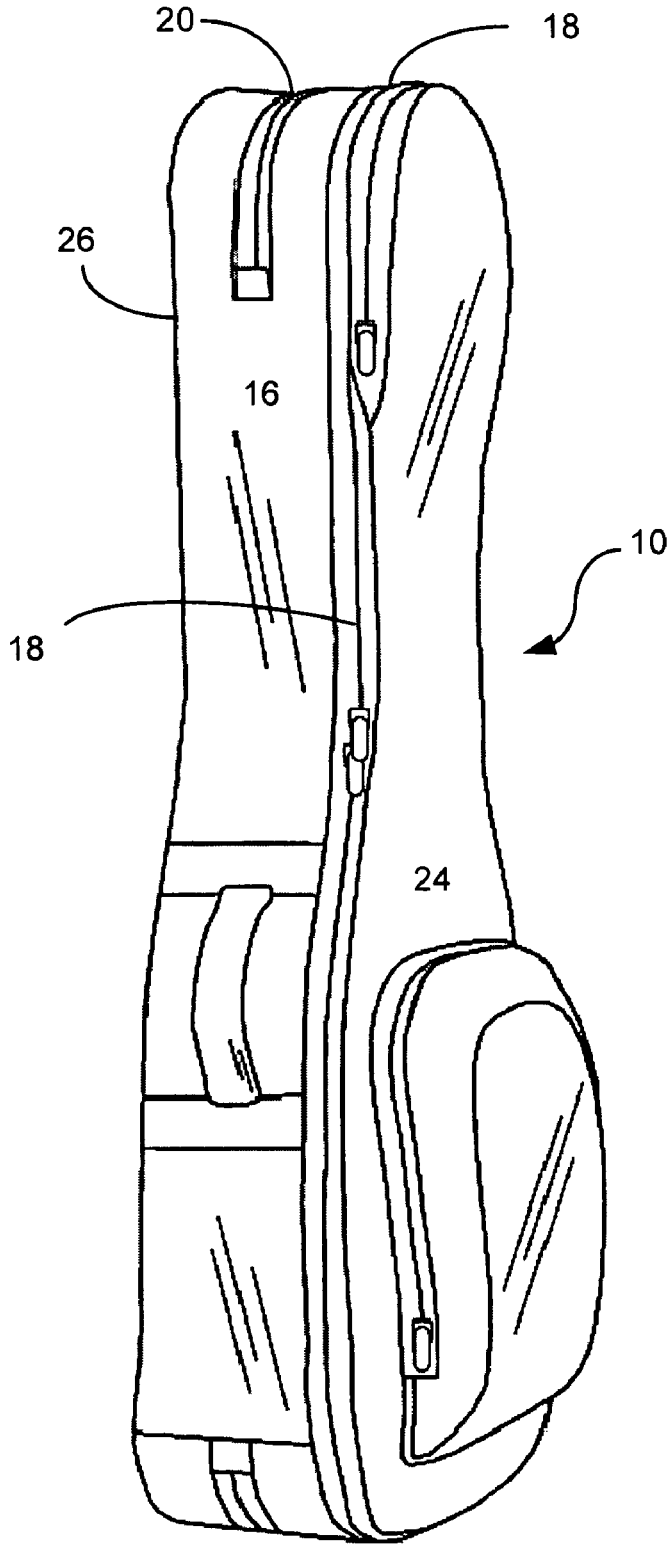
FIG. 1*b* illustrates the hybrid case of FIG. 1*a* wherein the case has been rotated to the right and the instruments have been entirely enclosed inside.
Figure 2A:
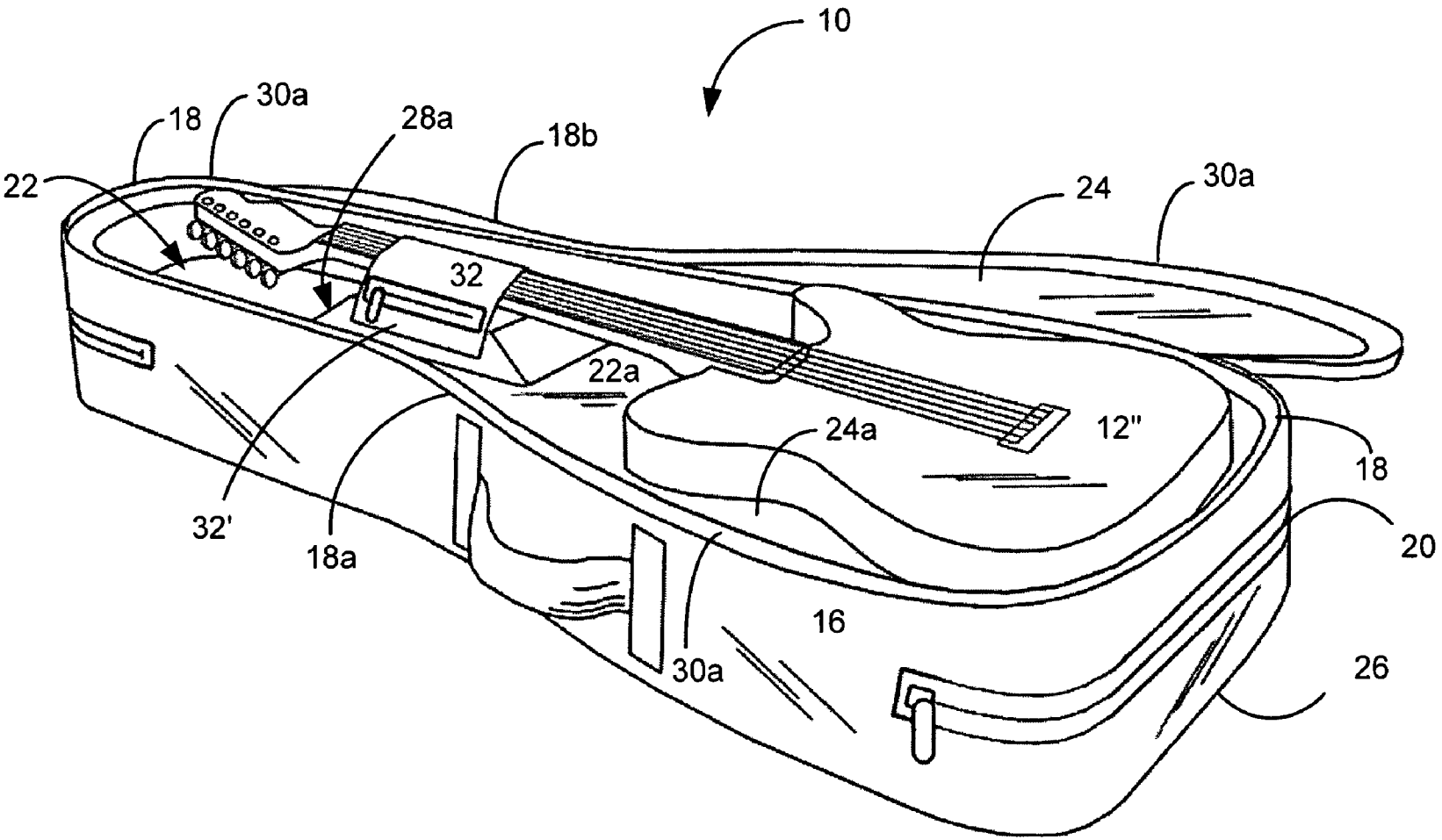
FIG. 2*a* is a first perspective view of the hybrid case of FIGS. 1*a* and 1*b*, wherein the front cover of the case has been opened to permit access to an instrument and the back cover of the case remains closed.
Figure 2B:
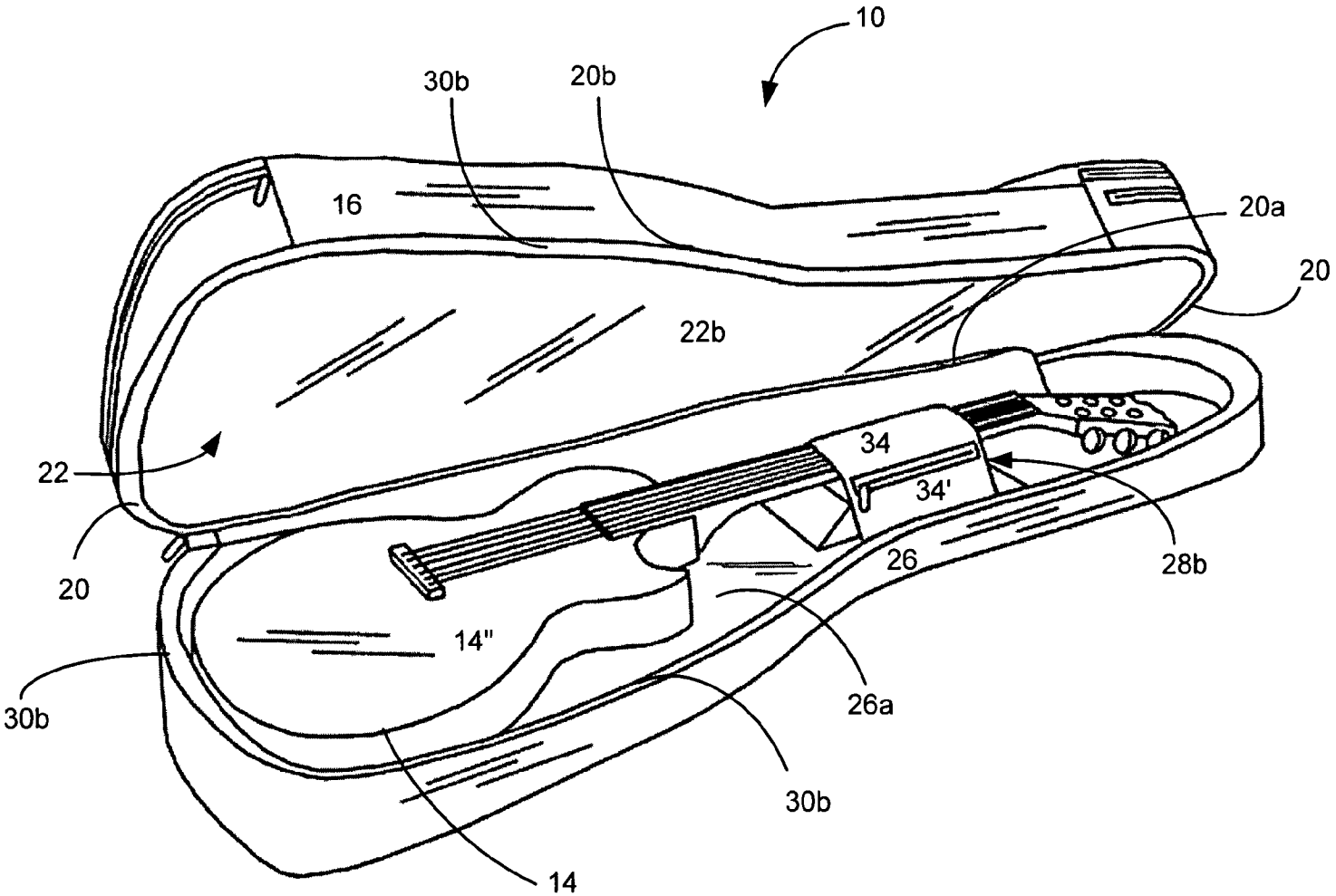
FIG. 2*b* is a second perspective view of the hybrid case of FIGS. 1*a*, 1*b* and 2*a*, wherein the back cover of the case has been opened to permit access to an instrument and the front cover of the case remains closed.

With joint reference to FIG. 1*a* through FIG. 2*b*, there is shown therein a preferred embodiment of the protective instrument case 10 of the present invention. By way of example, the invention is shown and described with reference to two electric guitars 12 and 14. However, the protective case according to FIG. 1*a* through FIG. 2*b* can be used not only for guitars but also for holding other combinations of electric and/or acoustic stringed instruments such as, e.g., double bass, cello, violin, bass-guitar, ukulele, etc. provided that the dimensions and overall shape are appropriate or modified accordingly. Each of the guitars 12 and 14 shown in the various drawings includes a neck 12' and 14', respectively, and a front face 12" and 14", respectively.

The protective instrument hybrid case 10 according to the present invention preferably includes a semi-rigid sidewall 16 that preferably forms a continuous loop and defines a front edge 18 with opposing first and second elongated sides 18*a* and 18*b*. The sidewall 16 may also define a back edge 20 with opposing first and second elongated sides 20*a* and 20*b*. As shown, the front and back edges 18 and 20 of the sidewall 16 are spaced apart from one another, preferably by a fixed distance. Hybrid case 10 may also include a generally planar partition 22 that is fixedly attached to sidewall 16 and that has front and back surfaces 22*a* and 22*b*, respectively. As shown, partition 22 includes a perimeter but, unlike covers 24 and 26, it is not hingedly attached to sidewall 16; rather, partition 22 is preferably fixedly attached to sidewall 16 along the entire partition perimeter.

As shown, case 10 may include a front cover 24 that is hingedly connected to at least a portion of the second elongated side 18*b* of front edge 18 of sidewall 16. Cover 24 is also preferably releasably fastened to at least a portion of the first elongated side 18*a* of front edge 18 of sidewall 16. In this way, front cover 24 can selectively enclose a front region of space between cover 24 and front surface 22*a* of partition 22. If an instrument is placed into the front region before front cover is fastened to side 18*a* of front edge 18, the instrument will thereby be enclosed between the front cover and the partition and the face of the enclosed instrument will abut front cover 24.

Hybrid case 10 may also include a back cover 26 hingedly connected to at least a portion of first elongated side 20*a* of back edge 20 of sidewall 16 and releasably fastened to at least a portion of second elongated side 20*b* of back edge 20 of sidewall 16. In this way, back cover 26 can selectively enclose a back region of space between cover 26 and back surface 22*b* of partition 22. If an instrument is placed into the back region before back cover 26 is fastened to side 20*b* of back edge 20, the instrument will thereby be enclosed between the front cover and the partition and the face of the enclosed instrument will abut the back surface 22*b* of partition 22.

As shown in the drawings, front cover 24 is preferably generally planar and back cover 26 is preferably not generally planar. It will be appreciated that the distance between edges 18 and 20 of sidewall 16 (preferably a fixed distance) and the configuration of back cover 26 will be determined in part by the anticipated thickness of the instruments to be enclosed inside of case 10. For example, the distance between edges 18 and 20 should be selected to be greater if case 10 is designed to accommodate a hollow body acoustic guitar than if it designed to accommodate a solid body electric guitar.

The hinge structure in accordance with the invention preferably takes the form of a flexible material such as cloth affixed to a cover and to a sidewall along the relevant elongated side. In such a case, the entire remaining portion of the opposing edge of the sidewall may be releasably fastened to the relevant cover by a suitable fastener such as a zip fastener or a zipper (see 30*a* and 30*b*). The fastener/closure mechanism may also take the form of any one or combination of well-known securing mechanisms such as hook and loop fastener(s), a mechanical lock, mechanical latches, one or more snap fasteners, etc. It will be appreciated that this preferred arrangement ensures that the fastener releasably fastens at least a portion of the elongated side opposite to the elongated side that has the hinge.

It will be appreciated that any or all of sidewall 16, front cover 24, back cover 26 and partition 22 may be formed of flexible material if desired. However, materials for these components are preferably selected to permit case 10 to substantially maintain its form when only one instrument is enclosed within either the front region of space or within the back region of space. This can be achieved with the use of a semi-rigid material at least for sidewall 16. However, additional protection will be provided by embodiments that also use semi-rigid material for partition 22 and for front and back covers 24 and 26.

It will also be appreciated that the opposing hinge/releasable fastener arrangement of the disclosed inventive double hybrid cases permits a user to access the back region of space without accessing the front region of space. Indeed, it will be appreciated the opposing hinge/releasable fastener arrangement described above permits a user to access either one of the front region of space or the back region of space without accessing the other one of the front region of space or the back region of space. An additional benefit of the opposing hinge/releasable fastener arrangement described above is that both of the front and back covers can be fully open simultaneously.

One optional feature of the preferred embodiment is a front neck-brace 28*a* affixed to a location on the front surface 22*a* of partition 22 and a back neck-brace 28*b* affixed to a corresponding location on the inside surface 26*a* of back cover 26. Front neck-brace 28*a* may be generally trapezoidal in side elevation and may have at least one retaining band 32 that may be used to releasably secure the first instrument neck 12' to the front neck-brace28*a*. Retaining band 32 may also include a resealable storage pocket 32' that may be accessed whether or not first instrument neck 12' has been secured to the front neck-brace 28*a*. Similarly, back neck-brace 28*b* may be generally trapezoidal in side elevation, may have at least one retaining band 34 for releasably securing the second instrument neck 14' to back neck-brace 28*b* and may include a resealable storage pocket 34' that may be accessed whether or not the second instrument neck 14' has been secured to back neck-brace 28*b*.

Use of such neck braces provides significant protection of instruments at the (typically) vulnerable neck/headstock joint and does so with very little additional parts/components/materials than a conventional flexible case. In this way, the invention offers the enhanced protection typically associated with a conventional hard-shell case and the convenience and light weight typically associated with a conventional gig-bag.

Another optional feature of the invention is the use of a single, unitary handle (see especially FIGS. 1*b* and 2*a*) fixedly attached to sidewall 16 between front cover 24 and back cover 26. This handle arrangement is made possible by the relationship between the sidewall 16, front cover 24 and rear cover 26 as discussed herein. It is also preferable to the various double-handle arrangements of the prior art in which separate handles are placed next to one another to form a two-part handle to be grasped by a user when carrying a prior art case.

As used herein, "flexible" generally means capable of substantial deformation without a tendency to break and without a natural tendency to return to its original form. Examples of some flexible shell materials include woven cottons, nylon, cordura, vinyl and other natural or synthetic textiles.

As used herein, "semi-rigid" generally means capable of substantial deformation without a tendency to break but with a natural tendency to return to its original form Examples of some semi-rigid materials include polyurethane, high density and "memory" foams, as well as foams layered with other natural or synthetic textiles.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A hybrid case for the protection of up to two stringed musical instruments, each of the instruments having a neck and the case comprising:

a semi-rigid, continuous sidewall defining a front edge with opposing first and second elongated sides and a back edge with opposing first and second elongated sides, wherein the front and back edges of the sidewall are spaced apart from one another;

a semi-rigid partition fixedly attached to the sidewall and having front and back surfaces;

a front cover hingedly connected to at least a portion of the second elongated side of the front edge of the sidewall and releasably fastened to at least a portion of the first elongated side of the front edge of the sidewall such that the front cover can selectively enclose a front region of space between the front cover and the front surface of partition;

a back cover hingedly connected to at least a portion of the first elongated side of the back edge of the sidewall and releasably fastened to at least a portion of the second elongated side of the back edge of the sidewall such that the back cover can selectively enclose a back region of space between the back cover and the back surface of the partition;

a front neck-brace for supporting the neck of a stringed musical instrument and affixed to a location on the front surface of the partition; and a back neck-brace for supporting the neck of a stringed musical instrument and affixed to a corresponding location on the inside of the back cover.

2. The hybrid case of claim 1, further comprising a unitary handle fixedly attached to the sidewall between the front cover and the back cover.

3. The hybrid case of claim 1, wherein the front cover is releasably fastened to at least a portion of the first elongated side of the front edge of the sidewall by a zipper and the back cover is releasably fastened to at least a portion of the second elongated side of the back edge of the sidewall by a zipper.

4. The hybrid case of claim 1, wherein the partition has a perimeter and the partition is fixedly attached to the sidewall along the entire partition perimeter.

5. The hybrid case of claim 1, wherein the front and back covers are hingedly and releasably fastened to the sidewall such that both of the front and back covers can be fully open simultaneously.

6. The hybrid case of claim 1, wherein the case is sufficiently rigid to substantially maintain its form when only one instrument is within either the front region of space or the back region of space.

7. The hybrid case of claim 1, wherein the back region of space is accessible without accessing the front region of space.

8. The hybrid case of claim 1, wherein either one of the front region of space or the back region of space is accessible without accessing the other.

9. The hybrid case of claim 1, wherein the front and back covers are semi-rigid.

10. The hybrid case of claim 1, wherein the front cover is generally planar and the back cover is not generally planar.

11. The hybrid case of claim 1, wherein the partition is not hingedly attached to the sidewall.

12. A protective hybrid case for first and second stringed musical instruments each having a neck and a face, the case comprising:

a semi-rigid, continuous sidewall defining a front edge with opposing first and second elongated sides and a back edge with opposing first and second elongated sides, wherein the front and back edges of the sidewall are spaced apart from one another;

a generally planar partition having a perimeter and being fixedly attached to the sidewall along substantially the entire perimeter;

a front cover hingedly connected to at least a portion of the second elongated side of the front edge of the sidewall and releasably fastened to at least a portion of the first elongated side of the front edge of the sidewall such that the front cover can selectively enclose the first stringed instrument in a front region between the front cover and partition;

a back cover hingedly connected to at least a portion of the first elongated side of the back edge of the sidewall and releasably fastened to at least a portion of the second elongated side of the back edge of the sidewall such that the back cover can selectively enclose the second musical instrument in a back region between the back cover and the partition;

a front neck-brace for supporting the neck of the first stringed instrument within the front region; and a back neck-brace for supporting the neck of the second stringed instrument within the back region.

13. The hybrid case of claim 12, further comprising a unitary handle fixedly attached to the sidewall between the front cover and the back cover.

14. The hybrid case of claim 12, wherein the partition further comprises a front surface and a back surface, wherein the face of the first instrument abuts the front cover when the first instrument is selectively enclosed between the front cover and the partition, and wherein the face of the second instrument abuts the back surface of the partition when the second instrument is selectively enclosed between the back cover and the partition.

15. The hybrid case of claim 12, wherein the front neck-brace is affixed to a location on the partition and the back neck-brace is affixed to a corresponding location on the back cover.

16. The hybrid case of claim 15, wherein the front neck-brace is generally trapezoidal in side elevation and further comprises at least one retaining band that is used to releasably secure the first instrument neck to the front neck-brace.

17. The hybrid case of claim 16, wherein the at least one retaining band further comprises a resealable storage pocket that is accessible whether or not the first instrument neck has been secured to the front neck-brace.

18. A hybrid case for the protection of two stringed musical instruments, each of the instruments having a neck and the case comprising:

a semi-rigid sidewall defining a front edge with opposing first and second elongated sides and a back edge with opposing first and second elongated sides, wherein the front and back edges of the sidewall are spaced apart from one another;

a semi-rigid partition fixedly attached to the sidewall and having front and back surfaces;

front and back covers;

means for hingedly connecting the front cover to the second elongated side of the front edge of the sidewall and for releasably fastening the front cover to the first elongated side of the front edge of the sidewall whereby the front cover can selectively enclose a front region of space between the front cover and the front surface of partition;

means for hingedly connecting the back cover to the first elongated side of the back edge of the sidewall and for releasably fastening the back cover to the second elongated side of the back edge of the sidewall whereby the back cover can selectively enclose a back region of space between the back cover and the back surface of the partition;

a front neck-brace for supporting the neck of a stringed musical instrument and affixed to a location on the front surface of the partition; and a back neck-brace for supporting the neck of a stringed musical instrument and affixed to a location on the inside of the back cover.

19. The hybrid case of claim 18, wherein the means for releasably fastening the front cover to the first elongated side of the front edge of the sidewall is a zipper and the means for releasably fastening the back cover to the second elongated side of the back edge of the sidewall is a zipper.

20. The hybrid case of claim 19, wherein the partition has a perimeter and the partition is fixedly attached to the sidewall along the entire partition perimeter.

* * * * *